United States Patent [19]

Spangler

[11] 4,018,167

[45] Apr. 19, 1977

[54] PREASSEMBLED BRACKET AND SHELF ASSEMBLY

[75] Inventor: Morris H. Spangler, Streamwood, Ill.

[73] Assignee: Reflector Hardware Corporation, Melrose Park, Ill.

[22] Filed: May 2, 1975

[21] Appl. No.: 573,982

[52] U.S. Cl. ..... 108/152; 248/250

[51] Int. Cl.[2] ..... A47B 57/16

[58] Field of Search ..... 108/107, 108, 152, 144; 248/243, 247, 248, 250; 211/135, 148, 149; 403/282; 16/149, 159; 24/73 MF

[56] References Cited

UNITED STATES PATENTS

| | | | |
|---|---|---|---|
| 2,056,808 | 10/1936 | Skar | 108/152 |
| 2,912,119 | 11/1959 | Robinson | 108/152 X |
| 2,964,814 | 12/1960 | Parkin | 24/73 MF |
| 3,115,972 | 12/1963 | Schild | 108/144 X |
| 3,127,146 | 3/1964 | Fisher | 248/250 |
| 3,186,668 | 6/1965 | Story | 211/148 X |
| 3,199,822 | 8/1965 | Ruhnke | 248/250 X |

*Primary Examiner*—Ramon S. Britts
*Assistant Examiner*—William E. Lyddane
*Attorney, Agent, or Firm*—Dressler, Goldsmith, Clement, Gordon & Shore, Ltd.

[57] ABSTRACT

A shelf assembly which is assembleable without extraneous fasteners and which may be shipped flat and ready for attachment to a pair of spaced standards. The assembly comprises an expansive shelf of formed sheet metal having an upper shelf surface portion and a lower portion which provides groups of spaced slots opening into hollows within the shelf. Shelf support brackets, each having an expansive main body portion, hooks for supporting the assembly on a standard and a pair of mounting ears integral with the bracket extend laterally from the upper regions of the bracket main body portion. The mounting ears are seated within the hollows of a corresponding group of slots. The ears on each bracket have projections by which the shelf and bracket are interconnected. At least one projection is a protuberance, the combined width of the ear and the protuberance being greater than the width of the slot portion through which that ear entered. One ear has a hook-like projection. The projections serve to resist withdrawal and separation of the bracket from the shelf.

When a bracket is to be connected to a shelf, the hook-like projection is inserted through one slot and the other ear bearing the projection is snapped through the other slot. The bracket is then rotated 90 degrees to position it for securance to a hook receiving standard. The bracket, the shelf assembly and the method of assembling them are all disclosed herein.

8 Claims, 14 Drawing Figures

PREASSEMBLED BRACKET AND SHELF ASSEMBLY

This invention relates to improved merchandise display equipment and particularly to an improved shelf and bracket assembly especially adapted for quick installation and use in retail stores.

A wide variety of brackets and shelves are available on the market and are disclosed in prior art. Many take the form of brackets securable to standards, with shelves being supportable on the brackets. In a number of prior art constructions means are provided for securing the shelves to the brackets, thereby to eliminate accidental separation of the shelves and brackets in use. Typical shelf and bracket arrays are those illustrated in U.S. Pat. Nos. 2,919,034 and 3,199,822.

In accordance with the present invention shelves and brackets are provided which may be easily secured to each other, without extraneous fasteners, and which may not be separated from one another when supported on a pair of spaced standards. Additionally, the brackets are easily and quickly preassembled with a shelf and may lie flat against the shelf to permit shipment of a flat shelf assembly to a job site where it is necessary only to rotate the brackets to ready the entire assembly for mounting on a pair of standards. This makes it possible to more quickly complete a job at a job site and makes it unnecessary, when desirable, to ship separate shelves and brackets. Further, the shelf and bracket assembly of this invention makes possible the preassembly of varying shapes, sizes and configurations either at a factory or at a central distribution center minimizing the entire assembly time at a job site.

A shelf assembly of this invention which is assembled without extraneous fasteners and which is ready for attachment to a pair of spaced standards may preferably comprise an expansive shelf, preferably of formed sheet metal, having an upper shelf surface portion and a lower portion defining at least two groups of spaced slots opening into hollows within the shelf, shelf support brackets, each having an expansive main body portion, hooks for supporting the assembly on a standard and at least one mounting ear and, preferably, at least two ears which are integral with the bracket and which extend laterally from the upper regions of the main body portion. The mounting ears are seated within the hollows of a corresponding group of slots, the number of slots in each group being at least as great as the number of ears on each bracket. At least one of the ears on each bracket has a protuberance, and the combined width of the ear and the protuberance is greater than the width of the slot portion through which that ear entered. Each of the brackets thereby resists withdrawal and separation from the shelf.

When each of the ears has protuberance, the combined width of each protuberance and its associated ear is greater than the width of the slot portion through which they entered. Each slot cooperable with a protuberance has a peripheral portion which comprises a locking flap which is distorted inwardly by an associated protuberance, and is redistorted outwardly thereby to narrow the slot portion to resist withdrawal of the ear from the associated hollow. The protuberance receiving slots are preferably generally C-shaped and the locking flaps comprise the portions lying between the spaced arms of the C.

A shelf support bracket in accordance with this invention preferably comprises an elongated, expansive main body portion having mounting hooks at one end for mounting the bracket to a standard, an upper shelf supporting surface at the upper edge of the bracket, at least one, and preferably two, shelf engaging ears extending laterally from the main body portion in the upper regions thereof, and at least one of the ears providing a projection means for interlocking the ear with a shelf, thereby to mechanically key the bracket to a shelf without extraneous fasteners. In its preferred form the projection means constitutes a hook portion on one of the ears and a protuberance adapted to snap into a slotted shelf on at least one of the ears.

This invention also contemplates an improved method of preassembling a plurality of brackets and a shelf without extraneous fasteners for subsequent attachment to at least one standard. According to that method an expansive shelf, such as a formed sheet metal shelf and shelf support bracket are provided. The shelf has an upper shelf surface and a lower surface portion defining at least two groups of spaced slots opening into hollows within the shelf and each shelf support bracket has an expansive main body portion, hooks for supporting engagement with a standard and at least one and preferably two mounting ears extending laterally from the upper regions of the main body portion, the mounting ears on each bracket being proportioned to enter a corresponding group of slots, at least one of the ears on each bracket having a protuberance and the combined width of the ear and the protuberance being greater than the width of the slot portion they are to enter. The method comprises the further steps of juxtaposing one of the bracket ears on each bracket with one of the slots and inserting the ear in the slot and then forcing an ear with a protuberance through an associated slot, each into the hollows, the protuberance distorting a peripheral portion of an associated slot inwardly. Then, while retaining the ears within the hollows, each shelf support bracket is rotated to a position in which the plane of the hooks of each bracket is generally perpendicular to the plane of the upper shelf surface, thereby to ready the assembly for attachment to bracket hook receiving standards.

More particularly, the peripheral portions comprise locking flaps which are distorted inwardly by an associated protuberance, and the locking flaps are redistorted outwardly as the bracket is rotated to the generally perpendicular position thereby to narrow the slot to resist withdrawal of the ear when the bracket ear is returned to its pre-rotated position within the hollow in the shelf. When one of the ears defines an interlocking hook portion, the hook portion is first inserted into one of the slots and thereafter the remaining ears are moved into juxtaposed position with the corresponding spaced slots, following which the forcing and rotating steps are performed.

These and further advantages, features and objects of this invention will become apparent from the following description and drawings of which:

Figure 1:
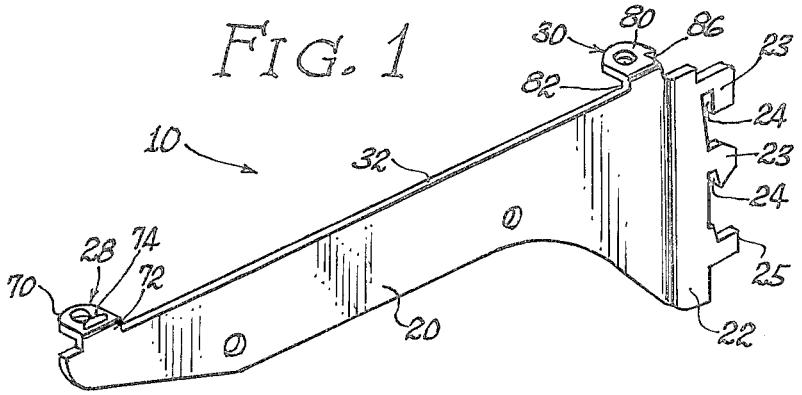
FIG. 1 is a perspective view of a shelf support bracket of this invention.
Figure 2:
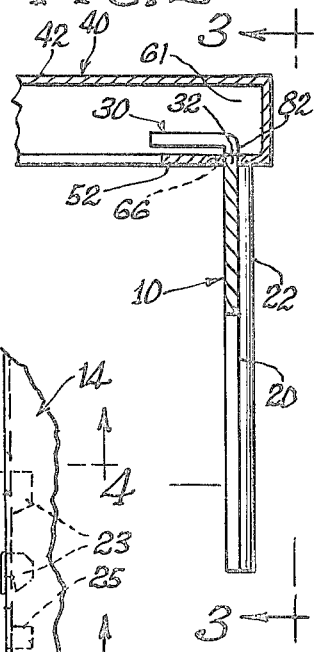
FIG. 2 is a fragmentary cross-sectional view taken substantially along the plane 2—2 of FIG. 3.
Figure 3:
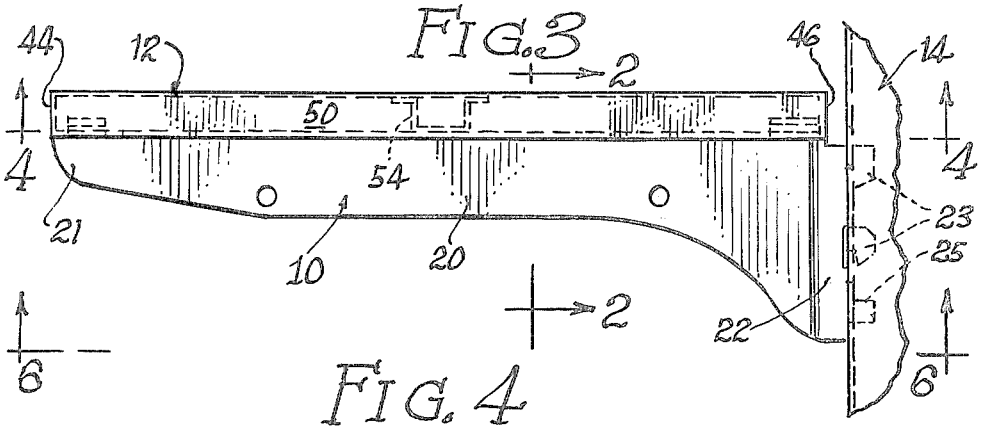
FIG. 3 is an enlarged, fragmentary cross-sectional view of a bracket and shelf assembly of this invention taken substantially along the plane 3—3 of FIG. 2.
Figure 4:
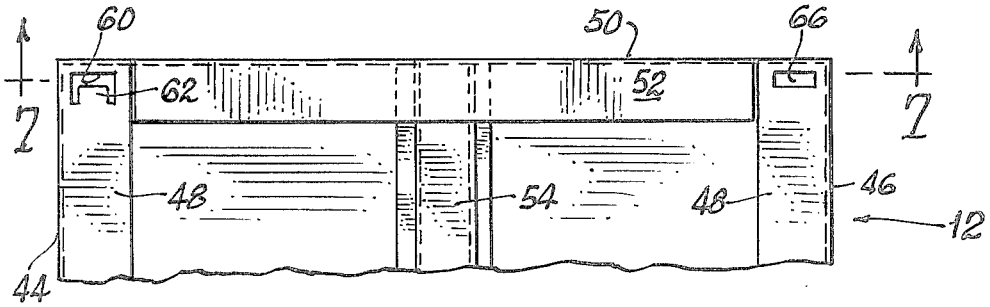
FIG. 4 is a bottom fragmentary view of a shelf taken substantially along the plane 4–4 of FIG. 3.
Figure 8:
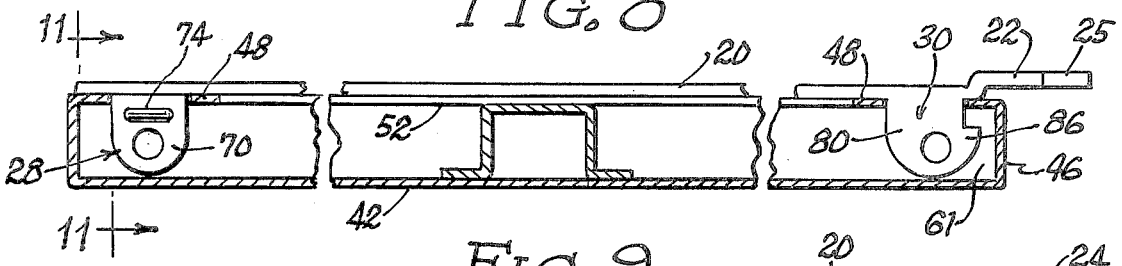
FIG. 8 is a view like FIG. 7 taken substantially along the plane 8—8 of FIG. 5.
Figure 9:
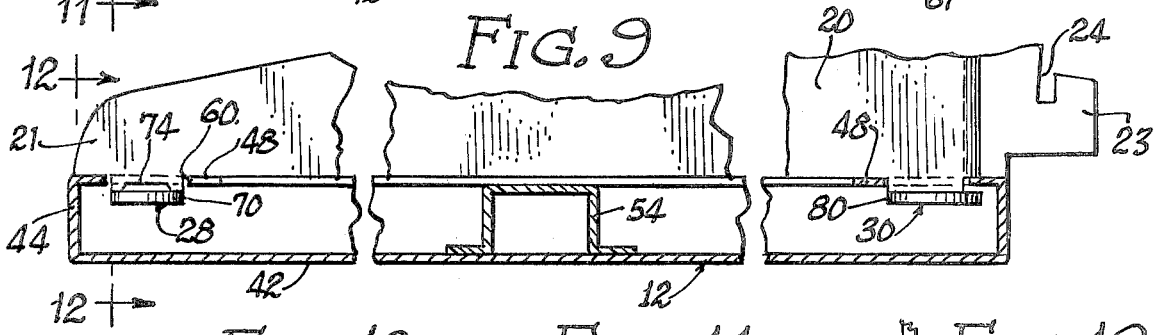
FIG. 9 is a fragmentary cross-sectional view like FIG. 7 taken substantially along the plane 9—9 of FIG. 6.
Figure 10:
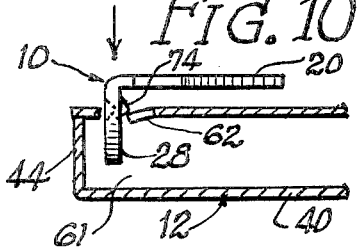
FIG. 10 is a fragmentary view illustrating the manner of assembly of a bracket of FIG. 1 with a shelf of FIG. 4.
Figure 11:
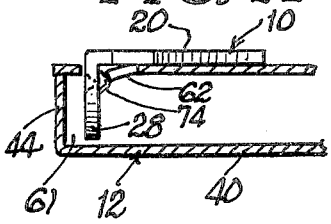
Figure 12:
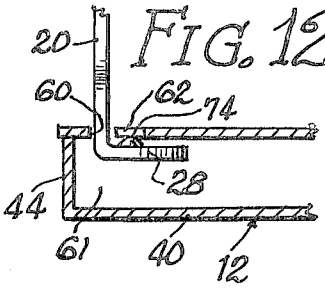
Figure 13:
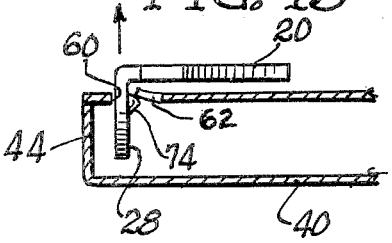
Figure 14:
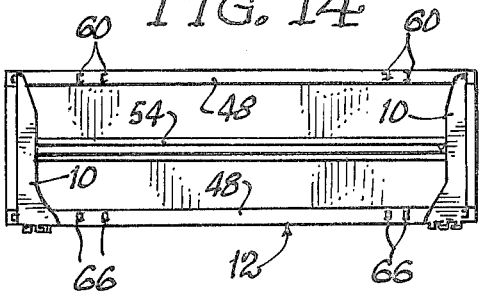

FIGS. 11 and 12 are cross-sectional views taken substantially along the planes 11—11 and 12—12 of FIGS. 8 and 9, respectively;

FIG. 13 is a view similar to FIG. 10 illustrating, however, the manner of disassembly of a bracket of FIG. 1 from a shelf of FIG. 4; and FIG. 14 is a bottom view of a bracket and shelf assembly of this invention with a pair of brackets assembled with a shelf.

Referring now to the drawings, a typical shelf support bracket of this invention, is configured to be releasably secured to a suitable shelf 12 without the use of extraneous fasteners. Once assembled, the bracket and shelf assembly is adapted to be secured to standards, such as a spaced pair of standards 14, via the bracket hooks.

Shelf support bracket 10 may be formed as from a flat piece of steel or aluminum and comprises a generally flat, expansive main body portion 20. Main body portion 20, as is customary, tapers forwardly to a narrow front edge 21, whereas the rear edge 22 is of substantially greater height. The rear edge 22 is provided with suitable hooks 23, which are configured to be inserted in conventional slots in standards 14 and then dropped downwardly so that the bracket recesses 24 appropriately straddle front and rear surfaces of standards 14. If desired, more than two hooks 23 may be provided and one or more of these may be stabilizing hooks 25 which have no associated interlocking recesses. In the embodiment illustrated in FIG. 1, the rear edge portion 22 is Z-shaped in cross-section which Z-shape serves to enhance the structural stength of the shelf support bracket 10.

The shelf support bracket 10 is also provided with a pair of locking tabs or ears 28 and 30 which may be integral with bracket 10 and which are proportioned to fit and snap into, and to interlock with shelf 12 in the manner to be described. As illustrated in FIG. 1, locking ear 28 comprises a generally horizontal main ear portion 70 which extends laterally from the upper regions of shelf support bracket 10 and which is spaced slightly upwardly of the upper shelf supporting surface 32 by integral pedestal segment 72. A locking protuberance or projection 74 extends upwardly from ear portion 70. Locking ear 30 is similar to locking ear 28 and is formed to provide a main ear portion 80 and a pedestal segment 82. It may be provided with a locking protuberance or projection (not shown). Locking ear 80 provides a hook-like projection or extension 86 proportioned to interlock and key with shelf assembly 12.

Referring now to FIG. 4, a typical shelf 12 comprises a sheet metal main shelf body 40 having an upper shelf surface 42. Shelf 12 may be suitably punched and then formed as indicated. Shelf body 40 has a front and rear edge 44 and 46, respectively, which edges terminate at their bottoms in lower flanges 48. Shelf 12 terminates at its sides in side edges 50 which in turn terminate at their lower edges in lower side flanges 52. A hat-shaped channel 54 may be secured, as by welding or brazing, to the lower portion or main shelf body 40, thereby rigidifying and strengthening shelf 12.

Figure 7:
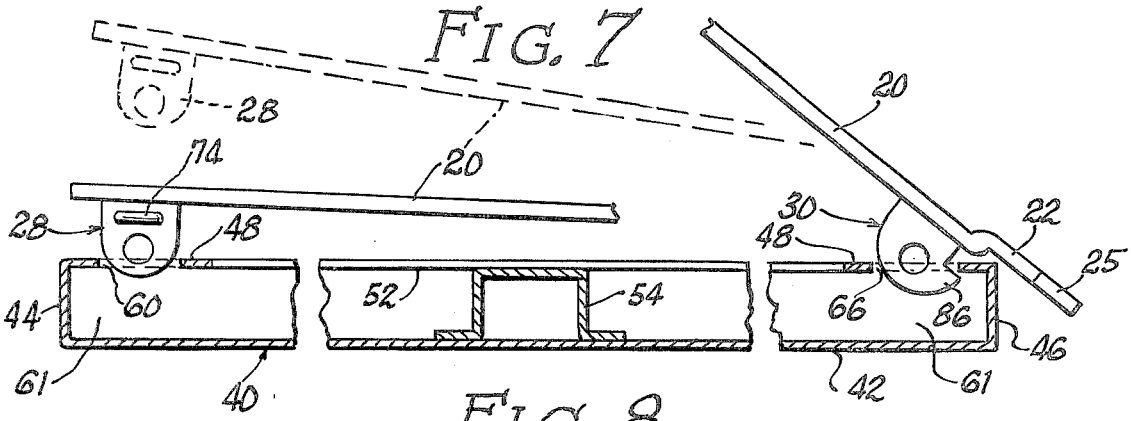
FIG. 7 is an enlarged cross-sectional view taken substantially along the plane 7—7 of FIG. 4 showing the stepwise assembly of a bracket of FIG. 1 with the shelf of FIG. 4.

Lower flanges 48 at the lower shelf regions or position are provided with pairs of spaced pairs of slots 60 and 66 which open into hollows 61 (FIG. 7). C-shaped slots 60 define locking flaps 62 between the spaced arms of the C which are positioned and proportioned to cooperate with locking ears 28.

The combined widths of the ears 28 and projections 74 are greater than the widths of the slots 60 through which they will pass.

Shelf support bracket 10 is adapted to be releasably secured to a shelf 12 without extraneous fasteners via locking ears 28 and C-shaped slots 60, peripheral portions of which define the locking flaps 62, and by ears 30 and cooperating generally rectangular slots 66. As shown by FIG. 14, a plurality of spaced pairs or groups of spaced slots 60 and 66 are provided, so that brackets may be mounted at various locations along the length of the shelf. Referring first to FIG. 7, a bracket 10 may be secured to a shelf 12 by first inserting the hook-like extension 86 of ear 30 into a slot 66. The locking ear 30 is then pushed downwardly and into slot 66 and the bracket 10 is rotated from the position illustrated at the right hand side of FIG. 7, to the dotted line position of FIG. 7 and then to the left hand full line position of FIG. 7. From that position the juxtaposed locking ear 28 is both forced downwardly and home into the position illustrated in FIG. 8, i.e., from the position illustrated by FIG. 10 to that represented by FIG. 11, a position in which the locking projection 74 has distorted and pushed the locking flap 62 downwardly and have snapped into the hollow 61.

Figure 5:
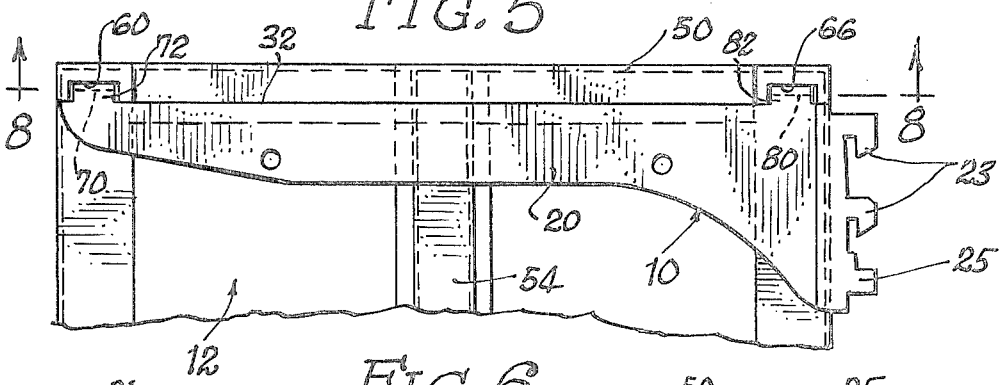
FIG. 5 is a fragmentary view similar to FIG. 4 of a bracket of FIG. 1 assembled with a shelf of FIG. 4.
Figure 6:
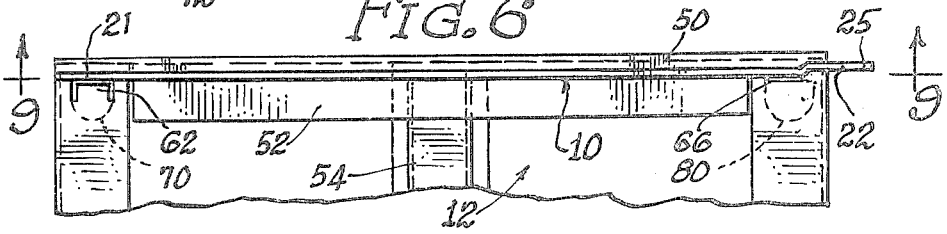
FIG. 6 is a view similar to FIG. 5 with a bracket rotated 90° from the position of FIG. 5.

Once the bracket 10 has assumed the position illustrated by FIGS. 8 and 11, and while retaining the ears within the hollows, bracket 10 is rotated 90° to the position illustrated in FIGS. 9 and 12, i.e., from the position of FIGS. 5 and 11 in which the planes of the hooks 23 and main body portion 20 are generally parallel to the upper shelf surface to that of FIG. 6 in which the planes of the hooks 23 and main body portions are generally perpendicular to the upper shelf surface. As that takes place, locking flap 62 is forced and redistorted upwardly until it reaches a position which is approximately coplanar with the remainder of the surfaces of flanges 48 and in which the shelf 12 is supported on upper bracket surfaces 32. In that position the slot 60 is narrowed to resist withdrawal of the ear 28 and a bracket 10 and a shelf assembly 12 are interlocked against easy separation of the bracket 10 from the shelf 12, all without extraneous fasteners. A shelf assembly which has been provided with two or more spaced brackets 10 is then ready to be secured as a unit with two or more spaced standards 14. When desired, an assembled bracket and shelf assembly may easily be disassembled without tools simply by rotating the bracket first from the position of FIGS. 6 and 12 to the position of FIGS. 5 and 11, and then by lifting a locking ear 28 to spring its locking flap 62 upwardly, as illustrated by FIG. 13, and then by reversing the assembly procedure described above in connection with the movements of a bracket and a locking ear 30 with respect to a shelf as described in connection with FIGS. 7 and 8.

Brackets having differing upper surface slopes and different hook configurations may be used. Shelves of different materials, sizes, shapes and modes of fabrication may be easily developed for use with a variety of brackets. Indeed, shelves may utilize metallic or plastic slot and hollow defining portions attached to portions defining an upper shelf surface. Bracket and shelf assemblies of this invention may be separately sold and may be assemblied at a job site or may be conveniently pre-assembled, as in the position of FIG. 8, for sale as a complete assembly and for use at a job site where only rotation from the position of FIG. 8 to the position of FIG. 9 will be necessary to ready the bracket and shelf assembly for use. The possibility of pre-assembling brackets with shelves in a substantially flat configuration, as illustrated by FIGS. 8 and 14 i.e., with the brackets lying generally flat against a lower portion of the shelf with the ears within the hollows, has substantial advantage, both from the point of view of ease in shipping and from the point of view of minimizing labor necessary to ready a shelf mounting at the site at which the job is to be done.

Although but a single embodiment of this invention has been described, it will be apparent to those skilled in the art that modifications may be made without departing from the spirit and scope of the invention. Accordingly, it is intended that this invention shall be limited only insofar as may be made necessary by the appended claims.

What is claimed is:

1. A shelf assembly for attachment to at least one standard, comprising an expansive shelf having an upper shelf surface and a lower portion defining at least two groups of spaced slots opening into hollows within said shelf; shelf support brackets for ready selective attachment and removal from said shelf, each bracket having an expansive main body portion, hooks for supporting the assembly on a standard and at least one mounting ear extending laterally from the upper regions of said main body portion, said mounting ears on said bracket being adapted to enter a corresponding group of said slots and to be seated within said hollows, at least one of said ears on each bracket having a protuberance, the combined width of the ear and the protuberance being slightly greater than the width of the slot portion through which the ear entered for accommodating snap-fitting interlocking engagement between the bracket and said shelf, whereby each of said brackets resists withdrawal and separation from the shelf and in which each said slot associated with a protuberance has a flexible peripheral portion comprising a flexible locking flap, said locking flap being positioned to be flexed inwardly by a said protuberance as said protuberance is pushed inwardly through said slot, and which flap is reflexed outwardly thereby to narrow the slot portion to resist withdrawal of the ear having the protuberance from the shelf.

2. A shelf assembly in accordance with claim 1 in which each of said brackets has at least two mounting ears and said shelf lower surface defines a plurality of groups of spaced slots, at least one said group being provided for each said bracket, with the number of slots in each group being at least as great as the number of mounting ears on each bracket.

3. A shelf assembly in accordance with claim 1 in which one of said ears on each said bracket defines a hook portion for resisting withdrawal of said ear from its associated slot.

4. A shelf assembly in accordance with claim 1 in which said ears are integrally formed with said brackets and said ears extend laterally from the upper shelf supporting edge of said bracket.

5. A shelf assembly in accordance with claim 1 in which said brackets are generally flat and in which said brackets lie flat against the lower portion of said shelf with said ears within said hollows.

6. A shelf assembly in accordance with claim 1 in which said brackets are generally flat and in which said brackets lie in planes generally perpendicular to the upper surface of said shelf with said ears within said hollows.

7. A shelf assembly for attachment to at least two standards, comprising at least two shelf support brackets; an expansive shelf having an upper shelf surface and a lower portion defining a plurality of groups of spaced slots opening into hollows within said shelf;

said shelf support brackets each having an expansive main body portion, hooks for supporting the assembly on a said standard and at least two mounting ears extending laterally from the upper regions of said main body portion, said mounting ears on each bracket being adapted to enter a corresponding group of said slots and being seated within said hollows, the number of slots in each group being at least as great as the number of mounting ears on each bracket;

at least one of said ears on each bracket having a protuberance, each said slot associated with a protuberance having a peripheral portion comprising a flexible locking flap, said locking flap being positioned to be flexed inwardly by a said protuberance as said protuberance is pushed inwardly through said slot, and which flap is reflexed outwardly thereby to narrow the slot portion to resist withdrawal of the ear from the shelf; and in which said slots associated with said protuberances are generally C-shaped and the locking flap comprises the portion lying between the spaced arms of the C, said combined width of the ear and the protuberance being greater than the width of the slot portion through which said ear having said protuberance entered, whereby each of said brackets resist withdrawal and separation from the shelf.

8. A shelf support bracket comprising an elongated, expansive main body portion having mounting hooks at one end for mounting the bracket to a standard, an upper shelf supporting surface at the upper edge of the bracket, at least one shelf engaging ear extending laterally from said main body portion in the upper regions thereof and having a projection means of a size and shape for accommodating snap-fitting interlocking engagement between said ear and a shelf, to mechanically key the bracket to a shelf without extraneous fasteners.

* * * * *

UNITED STATES PATENT AND TRADEMARK OFFICE

CERTIFICATE OF CORRECTION

PATENT NO. : 4,018,167

DATED : April 19, 1977

INVENTOR(S) : Morris H. Spangler

It is certified that error appears in the above-identified patent and that said Letters Patent are hereby corrected as shown below:

On the Title Page, the Assignee should be -- Reflector-Hardware Corporation --;

Col. 1, line 57, before "protuberance" insert -- a --;

Col. 3, line 66, "80" should be -- 30 --;

Col. 6, lines 55 et seq. (Claim 8) were cancelled during prosecution and therefore are not part of U. S. Patent 4,018,167.

On the Title Page after the abstract, " 8 Claims" should read -- 7 Claims --.

Signed and Sealed this

*ninth* Day of *August 1977*

[SEAL]

*Attest:*

RUTH C. MASON
*Attesting Officer*

C. MARSHALL DANN
*Commissioner of Patents and Trademarks*